US009816247B2

(12) United States Patent
Saeki et al.

(10) Patent No.: US 9,816,247 B2
(45) Date of Patent: Nov. 14, 2017

(54) LID FOR UNDERGROUND STRUCTURE

(71) Applicant: Hinode, Ltd., Fukuoka (JP)

(72) Inventors: Eiichiro Saeki, Fukuoka (JP); Norio Shinohara, Fukuoka (JP); Takefumi Andou, Fukuoka (JP)

(73) Assignee: HINODE, LTD., Fukuoka (JP)

( * ) Notice: Subject to any disclaimer, the term of this patent is extended or adjusted under 35 U.S.C. 154(b) by 91 days.

(21) Appl. No.: 14/767,909

(22) PCT Filed: Feb. 17, 2014

(86) PCT No.: PCT/JP2014/053636
§ 371 (c)(1),
(2) Date: Aug. 13, 2015

(87) PCT Pub. No.: WO2014/126239
PCT Pub. Date: Aug. 21, 2014

(65) Prior Publication Data

US 2015/0376860 A1 Dec. 31, 2015

(30) Foreign Application Priority Data

Feb. 18, 2013 (JP) ..... 2013-028955

(51) Int. Cl.
*E02D 29/14* (2006.01)
*E03F 5/02* (2006.01)

(52) U.S. Cl.
CPC ..... *E02D 29/14* (2013.01); *E02D 29/149* (2013.01); *E02D 29/1472* (2013.01); *E03F 5/02* (2013.01)

(58) Field of Classification Search
CPC . E02D 29/14; E02D 29/1472; E02D 29/1409; E02D 2300/0001
See application file for complete search history.

(56) References Cited

U.S. PATENT DOCUMENTS 2,109,287 A * 2/1938 Elkington ..... E02D 29/14 404/25
3,561,470 A * 2/1971 Hawle ..... E03B 9/10 137/371

(Continued)

FOREIGN PATENT DOCUMENTS

JP S5973449 U 5/1984
JP 08120701 A 5/1996

(Continued)

OTHER PUBLICATIONS

International Search Report from PCT Patent Application Serial No. PCT/JP2014/053636, dated Apr. 15, 2014, 2 pages.

*Primary Examiner* — Abigail A Risic
(74) *Attorney, Agent, or Firm* — Kinney & Lange, P.A.

(57) ABSTRACT

An inner peripheral portion of a receiving frame and an outer peripheral portion of a lid body each include first and second surface parts. In the closed-lid state, the first surface part of the lid body is supported by the first surface part of the frame, each of which include a gentle gradient. The second surface parts of the lid body and the receiving frame are pressed against each other by a force caused by elastic deformation of at least one of the outer peripheral portion of the lid body and the inner peripheral portion of the receiving frame. The second surface part of the receiving frame includes a steeper gradient than the first surface part of the receiving frame by reducing its diameter toward a downward direction of the receiving frame.

7 Claims, 9 Drawing Sheets

(56) References Cited

U.S. PATENT DOCUMENTS

| | | | | | |
|---|---|---|---|---|---|
| 4,408,421 | A * | 10/1983 | Pai | E02D 29/1409 | 404/26 |
| 4,861,186 | A * | 8/1989 | Ferns | E02D 29/14 | 404/25 |
| 5,165,819 | A * | 11/1992 | Bowman | E02D 29/14 | 404/26 |
| 6,036,401 | A * | 3/2000 | Morina | E02D 29/1409 | 137/370 |
| 6,953,301 | B2 * | 10/2005 | Koga | E02D 29/14 | 404/25 |
| 7,648,307 | B2 * | 1/2010 | Gondou | E02D 29/14 | 404/25 |
| 2007/0062125 | A1 * | 3/2007 | Gondou | E02D 29/14 | 52/19 |
| 2010/0012671 | A1 * | 1/2010 | Vrondran | E02D 29/14 | 220/810 |
| 2010/0043305 | A1 * | 2/2010 | Donnellan | E02D 29/124 | 52/20 |
| 2016/0090708 | A1 * | 3/2016 | Han | E02D 29/14 | 49/463 |

FOREIGN PATENT DOCUMENTS

| | | | |
|---|---|---|---|
| JP | 2010265599 | A | 11/2010 |
| JP | 2012021369 | A | 2/2012 |
| JP | 2012057435 | A | 3/2012 |
| JP | 3179066 | U | 9/2012 |
| JP | 2013007198 | A | 1/2013 |

* cited by examiner

LID FOR UNDERGROUND STRUCTURE

TECHNICAL FIELD

The present invention relates to a lid for an underground structure, including a lid body, and a receiving frame for supporting the lid body at its inner peripheral portion in an openable/closable manner.

Note that the term "lid for an underground structure" as used herein collectively refers to a manhole lid, a large iron lid, and a sewage inlet lid for openably closing an opening portion that connects underground buried objects and underground structure facilities in a sewer to the above ground; an iron lid for a common groove, an iron lid for power transmission, and an iron lid for power distribution which are openable and closable and protect underground facility equipment and underground cables, etc. in power and communication; and a fire hydrant lid, a water control valve lid, a gate valve lid, an air valve lid, a lid for gas piping, a water meter lid, etc. which function as an opening/closing door for connecting buried conduits and ancillary equipment thereof under the road surface in the water supply and gas pipings to the above ground.

BACKGROUND ART

Conventionally, as a lid for an underground structure, there is known a type of a flat receiving structure which is configured such that an outer diameter of a lid body is slightly smaller than an inner diameter of a receiving frame; an outer peripheral portion of the lid body and an inner peripheral portion of the receiving frame are substantially vertical planes; and a bottom surface of the lid body is supported by a shelf portion projecting from an inner periphery of the receiving frame. There is also known a type of a gradient receiving structure which is configured such that the outer diameter of the lid body is equal to the inner diameter of the receiving frame, and the outer peripheral portion of the lid body and the inner peripheral portion of the receiving frame are formed to have a steep gradient by reducing a diameter toward a downward direction such that the lid body bites into the receiving frame.

However, in a lid for an underground structure having a flat receiving structure, the configuration that the outer diameter of the lid body is slightly smaller than the inner diameter of the receiving frame results in a gap between the outer peripheral portion of the lid body and the inner peripheral portion of the receiving frame. For this reason, as a result of vehicles repeatedly travelling on the lid for an underground structure, there may be a case that the bottom surface of the lid body and the upper surface of the shelf portion are worn away, thereby causing rattling, vibration, and noise of the lid body.

In contrast to this, as a lid for an underground structure of a gradient receiving structure, Patent Document 1 describes a configuration in which inclination angles with respect to the vertical line of a gradient surface of the outer peripheral portion of a lid body and a gradient surface of the inner peripheral portion of a receiving frame are limited to 5° to 10°, and the height of the gradient surface of the outer peripheral portion of the lid body is smaller than the height of the gradient surface of the inner peripheral portion of the receiving frame. According to the configuration described in Patent 1, by limiting the angles of gradient surfaces as described above, it is possible to ensure a sufficient biting force of the lid body against the receiving frame, thereby significantly suppressing rattling, vibration, and noise of the lid body, and is also possible to achieve an effect that sliding up of the lid body seldom occurs.

PRIOR ART DOCUMENT

Patent Document

Patent Document 1: Japanese Patent Laid-Open No. 53-72357

SUMMARY OF THE INVENTION

Problems to be Solved by the Invention

However, in a lid for an underground structure described in Patent Document 1, although the above-described effect can be achieved, an excessive biting force of the lid body against the receiving frame may occur depending on the installation environment, and therefore there may be a case in which much effort is needed to open the lid with an opening/closing tool, thus making lid-opening work difficult.

Accordingly, an object of the present invention is to provide a lid for an underground structure which can suppress rattling, vibration, and noise of the lid body, and also can prevent the generation of the excessive biting force of the lid body against the receiving frame, allowing to open the lid with reasonable effort, as well as preventing the sliding up of the lid body with respect to the receiving frame.

Means for Solving the Problems

In order to achieve the above object, an aspect of the present invention is directed to a lid for an underground structure, including a lid body, and a receiving frame for supporting the lid body at an inner peripheral portion thereof in an openable/closable manner, wherein the inner peripheral portion of the receiving frame includes: a receiving-frame first surface part which is formed to have a gentle gradient by reducing a diameter toward a downward direction of the receiving frame; and a receiving-frame second surface part which is formed below the receiving-frame first surface part and with a steeper gradient than that of the receiving-frame first surface part by reducing a diameter toward a downward direction of the receiving frame, and an outer peripheral portion of the lid body includes: a lid first surface part which is formed to have a gentle gradient by reducing a diameter toward a downward direction of the lid body; and a lid second surface part which is formed below the lid first surface part and vertically toward the downward direction of the lid body, or with a steeper gradient than that of the receiving-frame second surface part by reducing a diameter toward the downward direction of the lid body, and wherein in a closed-lid state of the lid body, the lid first surface part is supported by the receiving-frame first surface part, and the lid second surface part and the receiving-frame second surface part are pressed against each other by a pressing force caused by elastic deformation of at least either one of the outer peripheral portion of the lid body and the inner peripheral portion of the receiving frame.

Moreover, a lid for an underground structure of the present invention is a lid for an underground structure, comprising a lid body, and a receiving frame for supporting the lid body at an inner peripheral portion thereof in an openable/closable manner, wherein the inner peripheral portion of the receiving frame includes: a receiving-frame first surface part which is formed to have a gentle gradient by reducing a diameter toward a downward direction of the receiving frame; a receiving-frame second surface part which is formed below the receiving-frame first surface part and with a steeper gradient than that of the receiving-frame first surface part by reducing a diameter toward the downward direction of the receiving frame; and a receiving-frame third surface part which is formed below the receiving-frame second surface part and with a gradient different from that of the receiving-frame second surface part by reducing a diameter toward the downward direction of the receiving frame, and an outer peripheral portion of the lid body includes: a lid first surface part which is formed to have a gentle gradient by reducing a diameter toward a downward direction of the lid body; a lid second surface part which is formed below the lid first surface part and vertically toward the downward direction of the lid body, or with a steeper gradient than that of the receiving-frame second surface part by reducing a diameter toward downward the direction of the lid body; and a lid third surface part which is formed below the lid second surface part and with a gradient different from that of the lid second surface part by reducing a diameter toward the downward direction of the lid body, and wherein in a closed-lid state of the lid body, the lid first surface part is supported by the receiving-frame first surface part, and at least either one of the lid second surface part and the lid third surface part, and at least either one of the receiving-frame second surface part and the receiving-frame third surface part are pressed against each other by a pressing force caused by elastic deformation of at least either one of the outer peripheral portion of the lid body and the inner peripheral portion of the receiving frame.

Moreover, the lid for an underground structure of the present invention is a lid for an underground structure, comprising a lid body, and a receiving frame for supporting the lid body at an inner peripheral portion thereof in an openable/closable manner, wherein the inner peripheral portion of the receiving frame includes: a receiving-frame first surface part which is formed to have a gentle gradient by reducing a diameter toward a downward direction of the receiving frame; a receiving-frame second surface part which is formed below the receiving-frame first surface part; and a receiving-frame fourth surface part which is formed below the receiving-frame second surface part and vertically toward the downward direction of the receiving frame, or with a gradient by expanding a diameter toward the downward direction of the receiving frame, and an outer peripheral portion of the lid body includes: a lid first surface part which is formed to have a gentle gradient by reducing a diameter toward a downward direction of the lid body; a lid second surface part which is formed below the lid first surface part; and a lid fourth surface part which is formed below the lid second surface part and vertically toward the downward direction of the lid body, or with a gradient by expanding a diameter toward the downward direction of the lid body, and wherein in a closed-lid state of the lid body, the lid first surface part is supported by the receiving-frame first surface part, and the lid fourth surface part and the receiving-frame fourth surface part are pressed against each other by a pressing force caused by elastic deformation of at least either one of the outer peripheral portion of the lid body and the inner peripheral portion of the receiving frame.

Preferably, the outer peripheral portion of the lid body includes a lid fifth surface part which is formed below the lid fourth surface part and with a gradient of an angle equal to that of the receiving-frame second surface part by reducing a diameter toward the downward direction of the lid body.

Preferably, when the lid body is first put into the receiving frame, and thus into the closed-lid state, as a result of an outer peripheral surface or a lower surface of the outer peripheral portion of the lid body coming into abutment with an inner peripheral surface of the inner peripheral portion of the receiving frame, the outer peripheral portion of the lid body and/or the inner peripheral portion of the receiving frame undergoes plastic deformation while the pressing force caused by elastic deformation remains.

Preferably, a plurality of cutout portions and/or a plurality of through holes are provided in a circumferential direction in the outer peripheral portion of the lid body and/or the inner peripheral portion of the receiving frame.

Preferably, the plurality of cutout portions and/or the plurality of through holes are provided in the outer peripheral portion of the lid body which is located below the lid second surface part and/or the inner peripheral portion of the receiving frame which is located below the receiving-frame second surface part.

Moreover, the lid for an underground structure of the present invention is configured such that the outer peripheral portion of the lid body which is located below the lid second surface part and/or the inner peripheral portion of the receiving frame which is located below the receiving-frame second surface part is formed of a plurality of protruding parts which are spaced apart in the circumferential direction and configured to protrude therefrom.

Preferably, at a base end of the protruding part, a concave part is provided so as to surround the protruding part.

Preferably, a reinforcing rib is provided on a back side of the lid body, and an end part of the reinforcing rib is separated from an inner peripheral wall of the outer peripheral portion of the lid body.

Advantageous Effects of the Invention

According to the present invention, in the closed-lid state of the lid body, the self-weight of the lid body and the load applied by a vehicle travelling on the lid body, etc., are supported by the receiving-frame first surface part with a gentle gradient, making it possible to prevent the generation of an excessive biting force of the lid body against the receiving frame.

Specifically, the lid second surface part and the receiving-frame second surface part, or at least either one of the lid second surface part and the lid third surface part and at least either one of the receiving-frame second surface part and the receiving-frame third surface part, or the lid fourth surface part and the receiving-frame fourth surface part are pressed against each other by the pressing force caused by elastic deformation of at least either one of the outer peripheral portion of the lid body and the inner peripheral portion of the receiving frame, making it possible to restrict the movement of the lid body in the radial direction. Further, when the lid body starts moving in an up-and-down direction, a friction force is generated between the lid second surface part and the receiving-frame second surface part, or between at least either one of the lid second surface part and the lid third surface part and at least either one of the receiving-frame second surface part and the receiving-frame third surface part, or between the lid fourth surface part and the receiving-frame fourth surface part, thus restricting the movement of the lid body in the up-and-down direction as well. Therefore, it is possible to prevent the generation of the excessive biting force of the lid body against the receiving frame, and also possible to suppress rattling, vibration, noise, and sliding up of the lid body by the pressing force and the friction force which are generated between the outer peripheral portion of the lid body and the inner peripheral portion of the receiving frame.

MODE FOR CARRYING OUT THE INVENTION

Hereafter, each embodiment of the present invention will be described with reference to the drawings.

Figure 1:
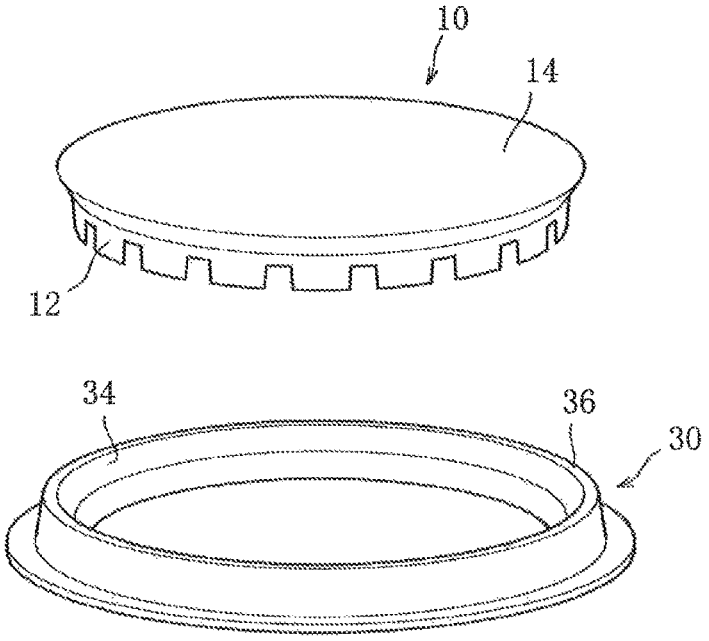
FIG. 1 is an exploded perspective view of a lid for an underground structure relating to the present invention.

As shown in FIG. 1, a lid for an underground structure relating to the present invention includes a lid body 10, and a receiving frame 30 for supporting the lid body 10 at its inner peripheral portion in an openable/closable manner, in which the lid body 10 and the receiving frame 30 are connected by a hinge metal, which is not shown. This lid for an underground structure is formed of spheroidal graphite cast iron, and is attached, for example, to an upper end part of an upper side mass of a manhole via a base adjustment part and is placed such that an upper surface 14 of the lid body 10 is flush with the ground surface.

Embodiment 1

Figure 2:
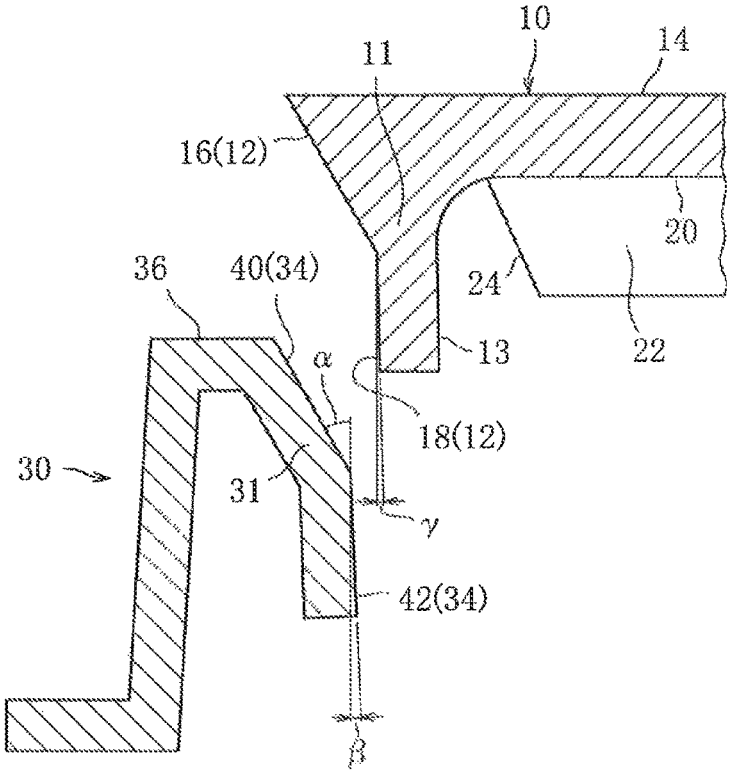
FIG. 2 is a longitudinal sectional view of a principal part of a lid for an underground structure relating to Embodiment 1 of the present invention.

FIG. 2 is a longitudinal sectional view of a principal part of the lid for an underground structure relating to Embodiment 1 of the present invention. An inner peripheral surface 34 formed in an inner peripheral portion 31 of the receiving frame 30 is made up of a receiving-frame first surface part 40 continuing to an upper surface 36 of the receiving frame 30, and a receiving-frame second surface part 42 below the receiving-frame first surface part 40.

The receiving-frame first surface part 40 is formed to have a gentle gradient by reducing a diameter toward a downward direction of the receiving frame 30. Specifically, the gentle gradient of the receiving-frame first surface part 40 refers to an angle ($\alpha$ of FIG. 2) ranging from 25° to 45° with reference to a vertical line, and the present embodiment is formed to have a gentle gradient $\alpha$ of 30°. Note that "gentle gradient" or "gradient" to be used in the description hereafter is all defined as an angle with reference to the vertical line.

Note that it has been revealed through numerical analysis that when a load is applied to the lid body 10 in a closed-lid state, if the gentle gradient $\alpha$ is less than 25°, the amount of sinking of the lid body 10 when load is applied is maintained even after the load is removed, indicating a state in which a biting force is generated. In contrast to this, it has also been revealed through numerical analysis that when the gentle gradient $\alpha$ is not less than 25°, the amount of sinking of the lid body 10 when load is applied is not maintained after the load is removed, indicating that a biting force is scarcely generated. Based on these results of numerical analysis, the gentle gradient $\alpha$ is set to be not less than 25° in the present application.

The receiving-frame second surface part 42 is formed below the receiving-frame first surface part 40 and with a steeper gradient than that of the receiving-frame first surface part 40 by decreasing a diameter toward the downward direction of the receiving frame 30. Specifically, the receiving-frame second surface part 42 is formed to have a gradient $\beta$ in a range of 1° to 10°. Note that in the present embodiment, the receiving-frame second surface part 42 is formed to have a gradient $\beta$ of 2°.

On the other hand, an outer peripheral surface 12 formed in an outer peripheral portion 11 of the lid body 10 is made up of a lid first surface part 16 continuing to the upper surface 14 of the lid body 10, and a lid second surface part 18 below the lid first surface part 16.

The lid first surface part 16 is formed to have a gentle gradient by reducing a diameter toward a downward direction of the lid body 10. Specifically, the lid first surface part 16 has substantially equal gentle gradient to that of the receiving-frame first surface part 40, and in the present embodiment, the lid first surface part 16 is formed to have a gentle gradient of 30° which is the same as the gentle gradient $\alpha$ of the receiving-frame first surface part 40.

The lid second surface part 18 is formed below the lid first surface part 16 to have a steeper gradient than that of the receiving-frame second surface part 42 by reducing a diameter toward the downward direction of the lid body 10. Specifically, the lid second surface part 18 is formed to have a gradient $\gamma$ in a range of 0° to 9°. Note that in the present embodiment, the lid second surface part 18 is formed to have a gradient $\gamma$ of 1°.

When the lid body 10 is put into the receiving frame 30 from the state of FIG. 2, a lower part of the lid second surface part 18 and a lower part of the receiving-frame second surface part 42 start abutting against each other. Further, when the lid body 10 is put into the receiving frame 30, thus being brought into a closed-lid state as shown in FIG. 3, at least either one of the outer peripheral portion 11 of the lid body 10 and the inner peripheral portion 31 of the receiving frame 30 deforms elastically, or deforms plastically while a pressing force caused by the elastic deformation remains, and the lid body 10 fits into the regular lid-closed position of the receiving frame 30.

Note that "elastic deformation" as used in the description hereafter is defined as a concept including plastic deformation while the pressing force caused by elastic deformation remains. Moreover, in the case of the present embodiment, as shown in FIG. 3, the outer peripheral portion 11 of the lid body 10 is greatly deformed from a state shown by a dotted line to a radial direction as shown by a solid line to be reduced in diameter. Although, to be specific, the inner peripheral portion 31 of the receiving frame 30 has also deformed elastically, since it is little compared with elastic deformation of the outer peripheral portion 11 of the lid body 10 in the present embodiment, the elastic deformation of the inner peripheral portion 31 of the receiving frame 30 will be omitted in FIG. 3 and the description below of the present embodiment. The same applies to any of the embodiments hereafter.

Figure 3:
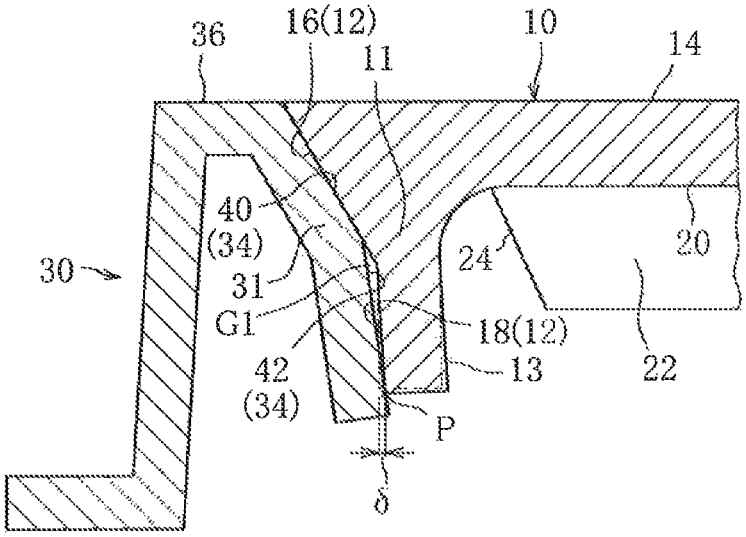
FIG. 3 is a longitudinal sectional view of a principal part of the lid for an underground structure relating to Embodiment 1 of the present invention in a closed-lid state in which a lid body is supported by a receiving frame.

In a closed-lid state as shown in FIG. 3, as a result of the lid first surface part 16 being supported by the receiving-frame first surface part 40, the self-weight of the lid body 10 and load applied by a vehicle etc., travelling on the lid body 10 are supported by the receiving-frame first surface part 40. Further, the lower part of the lid second surface part 18 and the lower part of the receiving-frame second surface part 42 come into abutment against each other, and the lid second surface part 18 and the receiving-frame second surface part 42 are pressed against each other by the pressing force caused by the elastic deformation of the outer peripheral portion 11 of the lid body 10.

The pressing force in this case is a restoring force which is generated as a result of the outer peripheral portion 11 of the lid body 10 being elastically deformed by a deflection amount $\delta$ from a natural state of FIG. 2, and which acts against the receiving-frame second surface part 42 from the lid second surface part 18 at an acting part P in a diameter-expanding direction.

As so far described, in the present embodiment, in a closed-lid state of the lid body 10, the self-weight of the lid body 10 and the load applied by a vehicle travelling on the lid body 10, etc., are supported at the receiving-frame first surface part 40 with a gentle gradient, making it possible to prevent the generation of an excessive biting force of the lid body 10 against the receiving frame 30. Moreover, as a result of that the lid second surface part 18 and the receiving-frame second surface part 42 are pressed against each other by the pressing force caused by the elastic deformation of the outer peripheral portion 11 of the lid body 10, the movement of the lid body 10 in the radial direction is restricted.

Further, in a closed-lid sate, since the pressing force caused by the elastic deformation of the outer peripheral portion 11 of the lid body 10 is acting, a friction force is generated between the lid second surface part 18 and the receiving-frame second surface part 42 when the lid body 10 moves in the up-and-down direction, thus restricting the movement of the lid body 10 in the up-and-down direction. Therefore, the receiving-frame first surface part 40 with a gentle gradient and the lid first surface part 16 with a gentle gradient make it possible to prevent the generation of an excessive biting force of the lid body 10 against the receiving frame 30. Moreover, the pressing force and the friction force which are generated between the outer peripheral portion 11 of the lid body 10 and the inner peripheral portion 31 of the receiving frame 30 make it possible to suppress rattling, vibration, noise, and sliding up of the lid body 10.

Note that in the present embodiment, by setting an inherent elastic modulus of the outer peripheral portion 11 of the lid body 10 and a section modulus of the outer peripheral portion 11 of the lid body 10, and an inherent elastic modulus of the inner peripheral portion 31 of the receiving frame 30 and a section modulus of the inner peripheral portion 31 of the receiving frame 30, the outer peripheral portion 11 of the lid body 10 is caused to undergo large elastic deformation. However, without being limited to that, it is also possible to set such that the inner peripheral portion 31 of the receiving frame 30 is caused to undergo large elastic deformation, or such that both the outer peripheral portion 11 of the lid body 10 and the inner peripheral portion 31 of the receiving frame 30 are caused to undergo appropriate elastic deformation.

Here, the present embodiment is configured such that, in a closed-lid state, an annular gap G1 is formed between the lid second surface part 18 and the receiving-frame second surface part 42 such that the lower part of the lid second surface part 18 and the lower part of the receiving-frame second surface part 42 come into abutment against each other. However, without being limited to that, by setting the elastic moduli of the outer peripheral portion 11 of the lid body 10 and the inner peripheral portion 31 of the receiving frame 30, and diameter dimensions and angles of the outer peripheral surface 12 of the lid body 10 and the inner peripheral surface 34 of the receiving frame 30, it is possible to control the abutment condition between the lid second surface part 18 and the receiving-frame second surface part 42. For example, there may be a case in which as a result of elastic deformation of the outer peripheral portion 11 of the lid body 10 and the inner peripheral portion 31 of the receiving frame 30, the lid second surface part 18 and the receiving-frame second surface part 42 come into contact in their whole areas, and thus no annular gap G1 is formed.

Note that in any of from the present embodiment to Embodiment 5 to be described later, when the lid body 10 is closed onto the receiving frame 30 for the first time, if both or one of the outer peripheral portion 11 of the lid body 10 and the inner peripheral portion 31 of the receiving frame 30 are forced to undergo plastic deformation while the pressing force caused by the elastic deformation remains, as the result of the outer peripheral surface 12 or a lower surface of the outer peripheral portion 11 of the lid body 10 and the inner peripheral surface 34 of the inner peripheral portion 31 of the receiving frame 30 coming into abutment against each other, it is possible to absorb dimensional errors of the outer peripheral surface 12 of the outer peripheral portion 11 of the lid body 10 and the inner peripheral surface 34 of the inner peripheral portion 31 of the receiving frame 30 without producing an excessive pressing force. Therefore, it is possible to obviate the strict management of the dimensional accuracy of the outer peripheral surface 12 of the outer peripheral portion 11 of the lid body 10 and the inner peripheral surface 34 of the inner peripheral portion 31 of the receiving frame 30, thereby significantly reducing the manufacturing cost. Further, by leaving the pressing force caused by the elastic deformation between the outer peripheral portion 11 of the lid body 10 and the inner peripheral portion 31 of the receiving frame 30, it is possible to prevent inadvertent opening of the lid body 10 due to vehicle passage etc., during normal time, and to allow an operator to easily open the lid body 10 during lid-opening work.

Figure 5:
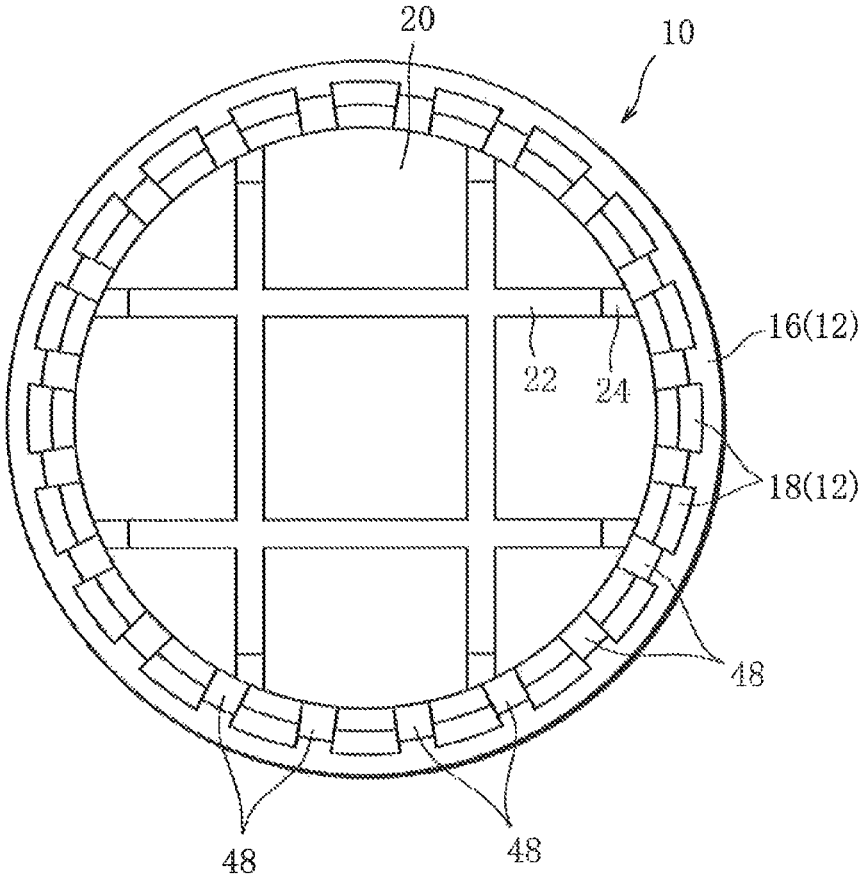
FIG. 5 is a plan view seen from the back side of the lid body of the lid for an underground structure relating to Embodiment 1 of the present invention.

As shown in FIGS. 2, 3, and 5, for example, a lattice-shaped reinforcing rib 22 is arranged in a back side 20 of the lid body 10 of the present embodiment. It is preferable that an end part 24 of the reinforcing rib 22 is separated from an inner peripheral wall 13 of the outer peripheral portion 11 of the lid body 10 such that the elastic deformation of the outer peripheral portion 11 of the lid body 10 will not be hindered when the lid body 10 is put into the receiving frame 30.

Figure 4:
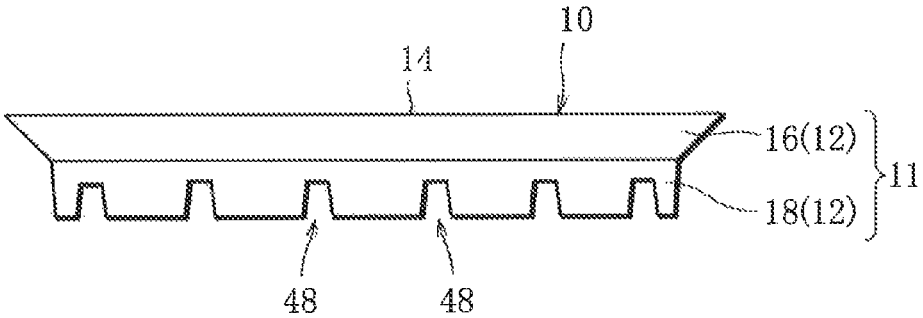
FIG. 4 is a side view of the lid body of the lid for an underground structure relating to Embodiment 1 of the present invention.

As shown in FIG. 4, in the outer peripheral portion 11 of the lid body 10 of the present embodiment, a plurality of cutout portions 48 are arranged at substantially equal intervals in a slit form in the circumferential direction, for example, in the lid second surface part 18. Since arranging the plurality of cutout portions 48 in a slit form in the outer peripheral portion 11 of the lid body 10 decreases the stiffness of the outer peripheral portion 11 of the lid body 10, it is preferable in that the elastic deformation of the outer peripheral portion 11 of the lid body 10 can be further facilitated.

Note that although, in the present embodiment, the plurality of cutout portions 48 are formed in a slit form in the outer peripheral portion 11 of the lid body 10, this is not limiting, and the plurality of cutout portions 48 can be formed in the inner peripheral portion 31 of the receiving frame 30, for example, by cutting out slits at substantially equal intervals in the circumferential direction in the receiving-frame second surface part 42, and in this case, it is possible to further facilitate the elastic deformation of the inner peripheral portion 31 of the receiving frame 30.

Figure 6:
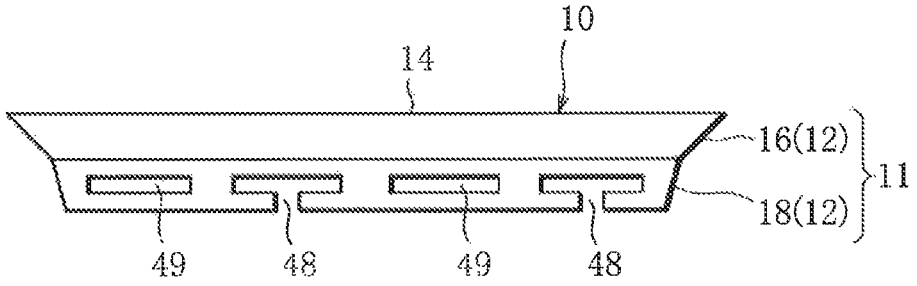
FIG. 6 is a side view of a lid body of a lid for an underground structure relating to another embodiment of the present invention.

Moreover, the shape of the cutout portion is not limited to the slit form, and may be the cutout portion 48 having a substantially T shape as shown in FIG. 6. Note that in further facilitating the elastic deformations of the outer peripheral portion 11 of the lid body 10 and the inner peripheral portion 31 of the receiving frame 30, the cutout portion 48 may be replaced by a through hole 49, and in FIG. 6, part of the cutout portions 48 are replaced by the through holes 49 of a window-frame shape.

Figure 7:
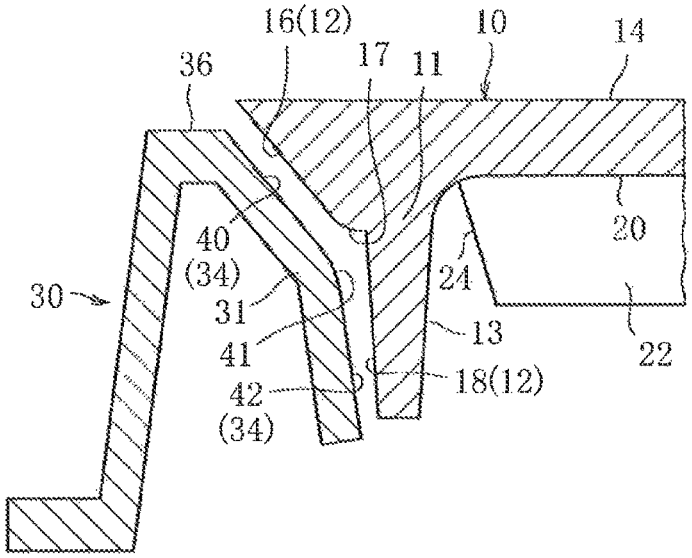
FIG. 7 is a longitudinal sectional view of a principal part of a lid for an underground structure relating to another embodiment of the present invention.

In the present embodiment, a receiving-frame second surface part 42 is formed continuously below the receiving-frame first surface part 40, and the lid second surface part 18 is formed continuously below the lid first surface part 16. However, without being limited to this, as shown in FIG. 7, the receiving-frame first surface part 40 and the receiving-frame second surface part 42, and the lid first surface part 16 and the lid second surface part 18 may be formed in a discontinuous fashion, respectively; for example, an R curved surface part 41 may be formed between the receiving-frame first surface part 40 and the receiving-frame second surface part 42, or an R curved surface part 17 may be formed between the lid first surface part 16 and the lid second surface part 18, and a step may be formed. Moreover, instead of the R curved surface parts (41, 17), a step and a slope may also be formed.

Embodiment 2

Figure 8:
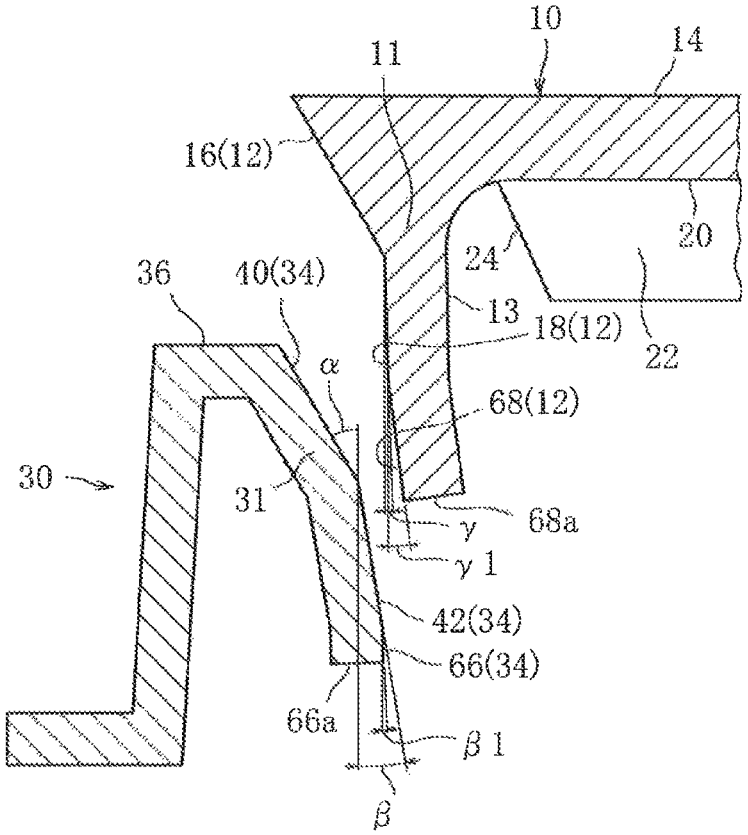
FIG. 8 is a longitudinal sectional view of a principal part of a lid for an underground structure relating to Embodiment 2 of the present invention.

FIG. 8 is a longitudinal sectional view of a principal part of a lid for an underground structure relating to Embodiment 2 of the present invention. Note that components overlapping with those of Embodiment 1 will be given the same reference symbols, thereby omitting the description thereof.

An inner peripheral surface 34 formed in an inner peripheral portion 31 of a receiving frame 30 of the present embodiment is made up of a receiving-frame first surface part 40 continuing to an upper surface 36 of the receiving frame 30, a receiving-frame second surface part 42 below the receiving-frame first surface part 40, and further a receiving-frame third surface part 66 below the receiving-frame second surface part 42.

The receiving-frame second surface part 42 is formed below the receiving-frame first surface part 40 to have a steeper gradient than that of the receiving-frame first surface part 40 by reducing a diameter toward a downward direction of the receiving frame 30. Moreover, the receiving-frame third surface part 66 is formed below the receiving-frame second surface part 42 to have a gradient different from that of the receiving-frame second surface part 42 by reducing a diameter toward the downward direction of the receiving frame 30. Specifically, the receiving-frame second surface part 42 is formed to have a gradient $\beta$ in a range of 1° to 10°, and the receiving-frame third surface part 66 is formed to have the same orientation as that of the receiving-frame second surface part 42, but have a different gradient $\beta 1$ which is more than 0°. Note that in the present embodiment, the receiving-frame second surface part 42 is formed to have a gradient $\beta$ of 8°, and the receiving-frame third surface part 66 is formed to have a gradient $\beta 1$ of 6° which is steeper than that of the receiving-frame second surface part 42.

On the other hand, an outer peripheral surface 12 which is formed in an outer peripheral portion 11 of a lid body 10 is made up of a lid first surface part 16 continuing to an upper surface 14 of the lid body 10, a lid second surface part 18 below the lid first surface part 16, and a lid third surface part 68 below the lid second surface part 18.

The lid second surface part 18 is formed below the lid first surface part 16 to have a steeper gradient than that of the receiving-frame second surface part 42 by reducing a diameter toward a downward direction of the lid body 10. Moreover, the lid third surface part 68 is formed below the lid second surface part 18 to have a gradient, which is equal in direction to, but different in quantity from that of the lid second surface part 18, by reducing a diameter toward the downward direction of the lid body 10. Specifically, the lid second surface part 18 is formed to have a gradient $\gamma$ in a range of 0° to 9°, and the lid third surface part 68 is formed to have a gradient $\gamma$ of more than 0°. Note that in the present embodiment, the lid second surface part 18 is formed to have a gradient $\gamma$ of 3°, and the lid third surface part 68 is formed to have a gradient $\gamma 1$ of 6° which is a gentler than that of the lid second surface part 18.

When the lid body 10 is put into the receiving frame 30 from the state of FIG. 8, first, the lid third surface part 68 and the receiving-frame second surface part 42 start abutting against each other, and next, the lid third surface part 68 and the receiving-frame third surface part 66 start abutting against each other. Further, when the lid body 10 is put into the receiving frame 30, thus coming into a closed-lid state shown in FIG. 9, at least either one of the outer peripheral portion 11 of the lid body 10 and the inner peripheral portion 31 of the receiving frame 30 deforms elastically and the lid body 10 fits into the regular closed-lid position of the receiving frame 30.

Figure 9:
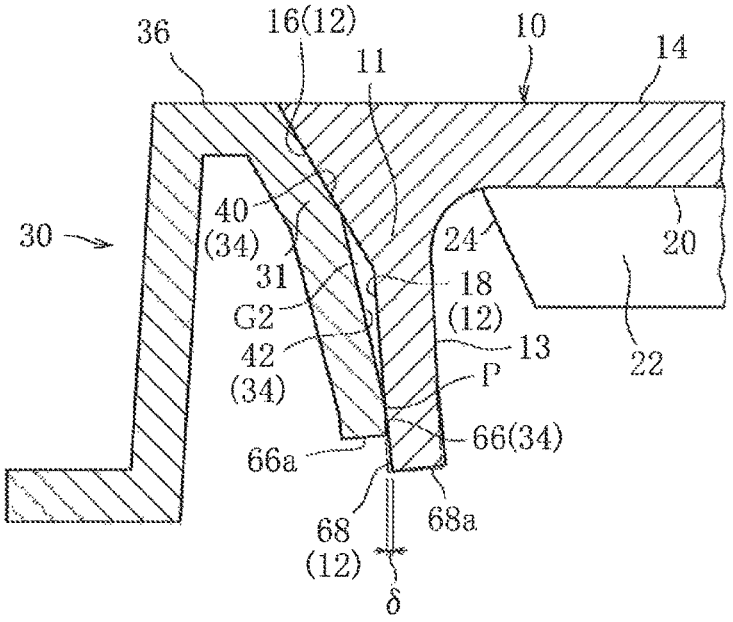
FIG. 9 is a longitudinal sectional view of a principal part of the lid for an underground structure relating to Embodiment 2 of the present invention in a closed-lid state in which a lid body is supported by a receiving frame.

In a closed-lid state as shown in FIG. 9, as a result of the lid first surface part 16 being supported by the receiving-frame first surface part 40, the self-weight of the lid body 10 and load applied by a vehicle etc., travelling on the lid body 10 are supported by the receiving-frame first surface part 40. Further, approximately middle position in an up-and-down direction of the lid third surface part 68 and an upper part of the receiving-frame third surface part 66 abut against each other, and the lid third surface part 68 and the receiving-frame third surface part 66 are pressed against each other by a pressing force caused by the elastic deformation of the outer peripheral portion 11 of the lid body 10.

The pressing force in this case is a restoring force which is generated as the result of the outer peripheral portion 11 of the lid body 10 being elastically deformed by a deflection amount δ from a natural state of FIG. 8, and which acts against the receiving-frame third surface part 66 from the lid third surface part 68 at an acting part P in a diameter-expanding direction of the lid body 10.

As so far described in the present embodiment, as in the case of Embodiment 1, in a closed-lid state of the lid body 10, the self-weight of the lid body 10 and load applied by a vehicle etc., travelling on the lid body 10 are supported by the receiving-frame first surface part 40 having a gentle gradient, making it possible to prevent the generation of an excessive biting force of the lid body 10 against the receiving frame 30. Moreover, the movement of the lid body 10 in a radial direction is restricted by the pressing force caused by the elastic deformation of the outer peripheral portion 11 of the lid body 10 and also, in a closed-lid state, a friction force is generated between the lid third surface part 68 and the receiving-frame third surface part 66, thus restricting the movement of the lid body 10 in the up-and-down direction. Therefore, it is possible to prevent the generation of an excessive biting force of the lid body 10 against the receiving frame 30. Moreover, the pressing force and the friction force which are generated between the outer peripheral portion 11 of the lid body 10 and the inner peripheral portion 31 of the receiving frame 30 make it possible to suppress rattling, vibration, noise, and sliding up of the lid body 10.

Here, the present embodiment is configured such that, in a closed-lid state, an annular gap G2 is formed between the lid second surface part 18 and the lid third surface part 68, and the receiving-frame second surface part 42 such that the lid third surface part 68 and the receiving-frame third surface part 66 come into abutment against each other. However, without being limited to that, by setting an elastic moduli of the outer peripheral portion 11 of the lid body 10 and the inner peripheral portion 31 of the receiving frame 30, and diameter dimensions and angles of the outer peripheral surface 12 of the outer peripheral portion 11 of the lid body 10 and the inner peripheral surface 34 of the inner peripheral portion 31 of the receiving frame 30, it is possible to control the abutment condition between the lid third surface part 68 and the receiving-frame third surface part 66. For example, in a closed-lid state, configuration may be such that at least either one of the lid second surface part 18 and the lid third surface part 68 comes into contact with at least either one of the receiving-frame second surface part 42 and the receiving-frame third surface part 66. Moreover, there may a case in which as a result of elastic deformations of the outer peripheral portion 11 of the lid body 10 and the inner peripheral portion 31 of the receiving frame 30, the lid second surface part 18 and the lid third surface part 68 come into contact with the receiving-frame second surface part 42 and the receiving-frame third surface part 66 in their whole areas, thus forming no annular gap G2.

Further, in the present embodiment, the receiving-frame second surface part 42 and the receiving-frame third surface part 66 are formed continuously in order below the receiving first surface part 40, and the lid second surface part 18 and the lid third surface part 68 are formed continuously in order below the lid first surface part 16. However, this is not limiting and, as in the case of Embodiment 1, configuration may be such that the receiving-frame first surface part 40 and the receiving-frame second surface part 42, and the receiving-frame second surface part 42 and the receiving-frame third surface part 66 may be formed discontinuously, and also the lid first surface part 16 and the lid second surface part 18, and the lid second surface part 18 and the lid third surface part 68 may be formed discontinuously.

Embodiment 3

Figure 10:
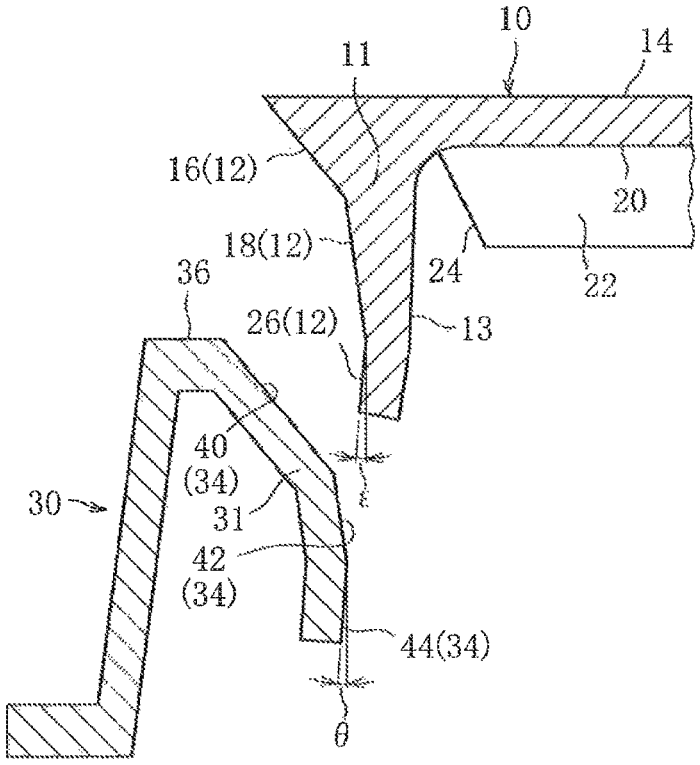
FIG. 10 is a longitudinal sectional view of a principal part of a lid for an underground structure relating to Embodiment 3 of the present invention.

FIG. 10 is a longitudinal sectional view of a principal part of a lid for an underground structure relating to Embodiment 3 of the present invention. Note that components overlapping with those of Embodiment 1 or 2 will be given the same reference symbols, thereby omitting the description thereof.

An inner peripheral surface 34 formed in an inner peripheral portion 31 of a receiving frame 30 of the present embodiment is made up of a receiving-frame first surface part 40 continuing to an upper surface 36 of the receiving frame 30, a receiving-frame second surface part 42 below the receiving-frame first surface part 40, and further a receiving-frame fourth surface part 44 below the receiving-frame second surface part 42.

The receiving-frame fourth surface part 44 is formed below the receiving-frame second surface part 42 to have a gradient by expanding a diameter toward a downward direction of the receiving frame 30. Specifically, the receiving-frame fourth surface part 44 is formed to have a gradient θ in a range of 0° to 9°, which is opposite in direction to that of the receiving-frame second surface part 42. Note that, in the present embodiment, the receiving-frame fourth surface part 44 is formed to have a gradient θ of 4°.

On the other hand, an outer peripheral surface 12 formed in an outer peripheral portion 11 of a lid body 10 is made up of a lid first surface part 16 continuing to an upper surface 14 of the lid body 10, a lid second surface part 18 below the lid first surface part 16, and further a lid fourth surface part 26 below the lid second surface part 18.

The lid fourth surface part 26 is formed below the lid second surface part 18 to have a gradient by expanding a diameter toward the downward direction of the lid body 10. Specifically, the lid fourth surface part 26 is formed to have a gradient E in a range of 0° to 10°, which is opposite in direction to that of the lid second surface part 18. Note that in the present embodiment, the lid fourth surface part 26 is formed to have a gradient ϵ of 5°.

Figure 11:
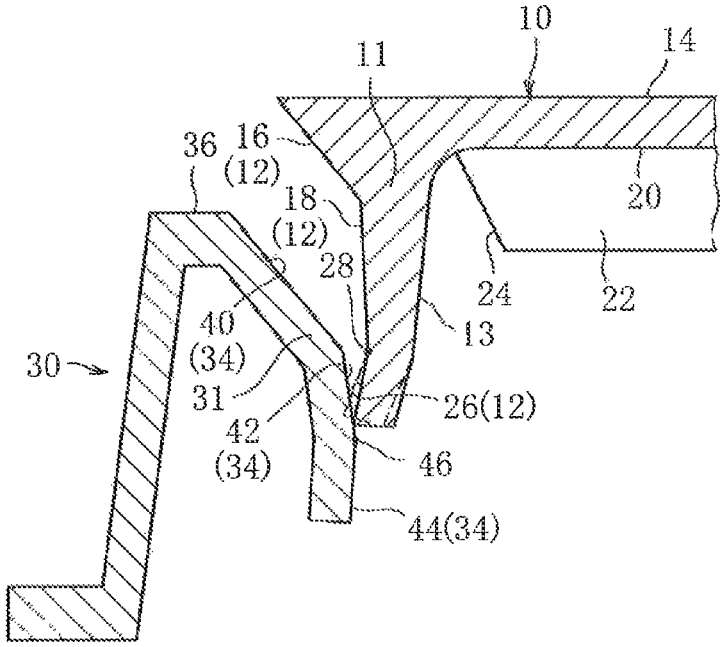
FIG. 11 is a longitudinal sectional view of a principal part of the lid for an underground structure relating to Embodiment 3 of the present invention, showing a state in which a lid fourth surface part is in abutment against a receiving-frame second surface part while the lid is being closed.

As shown in FIG. 11, when the lid body 10 is put into the receiving frame 30, a lower part of the lid fourth surface part 26 and the receiving-frame second surface part 42 start abutting against each other. When the lid body 10 is further put into the receiving frame 30, at least either one of the outer peripheral portion 11 of the lid body 10 and the inner peripheral portion 31 of the receiving frame 30 deforms elastically. Note that in the present embodiment, as shown in FIG. 11, the outer peripheral portion 11 of the lid body 10 is elastically deformed significantly in such a way that its diameter is reduced from a natural state shown by a dotted line to a state shown by a solid line.

Figure 12:
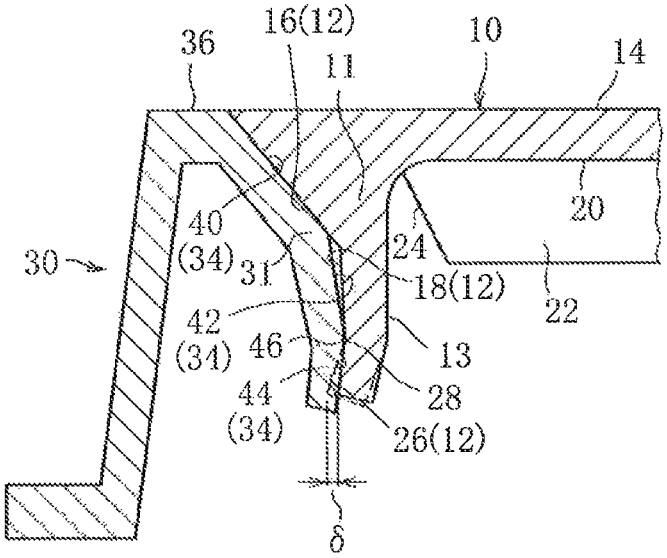
FIG. 12 is a longitudinal sectional view of a principal part of the lid for an underground structure relating to Embodiment 3 of the present invention in a closed-lid state in which a lid body is supported by a receiving frame.

In a closed-lid state shown in FIG. 12, the lid fourth surface part 26 has crossed a border 46 between the receiving-frame second surface part 42 and the receiving-frame fourth surface part 44 from the state of FIG. 11 so that a border 28 between the lid second surface part 18 and the lid fourth surface part 26 has approximately coincided with the border 46, and the lid body 10 has fit into the regular closed-lid position of the receiving frame 30.

In this state, as a result of the lid first surface part 16 being supported by the receiving-frame first surface part 40, the self-weight of the lid body 10 and load applied by a vehicle etc., travelling on the lid body 10 are supported by the receiving-frame first surface part 40. Further, the lid fourth surface part 26 and the receiving-frame fourth surface part 44 come into abutment against each other in the entire circumference, and the lid fourth surface part 26 and the receiving-frame fourth surface part 44 are pressed against each other by a pressing force caused by the elastic deformation of the outer peripheral portion 11 of the lid body 10. Further, as a result of the lid fourth surface part 26 and the receiving-frame fourth surface part 44 which have been expanded in diameter being pressed against each other, the outer peripheral portion 11 of the lid body 10 is retained in a state of being prevented from coming out from the inner peripheral portion 31 of the receiving frame 30.

The pressing force in this case is a restoring force which is generated as a result of the outer peripheral portion 11 of the lid body 10 being elastically deformed by a deflection amount δ from a natural state of FIG. 10, and acts against the receiving-frame fourth surface part 44 from the lid fourth surface part 26 in a diameter-expanding direction of the lid body 10.

As so far described, in the present embodiment, as in the case of Embodiments 1 and 2, in a closed-lid state of the lid body 10, the self-weight of the lid body 10 and load applied by a vehicle etc., travelling on the lid body 10 are supported by the receiving-frame first surface part 40 with a gentle gradient, making it possible to prevent the generation of an excessive biting force of the lid body 10 against the receiving frame 30. Moreover, as a result of that the lid fourth surface part 26 and the receiving-frame fourth surface part 44 are pressed against each other by a pressing force caused by the elastic deformation of the outer peripheral portion 11 of the lid body 10, the movement of the lid body 10 in a radial direction is restricted.

Further, in a closed-lid sate, since a pressing force caused by the elastic deformation of the outer peripheral portion 11 of the lid body 10 is acting, a friction force is generated between the lid fourth surface part 26 and the receiving-frame fourth surface part 44 when the lid body 10 moves in an up-and-down direction, thus restricting the movement of the lid body 10 in the up-and-down direction. Therefore, the receiving-frame first surface part 40 with a gentle gradient and the lid first surface part 16 with a gentle gradient make it possible to prevent the generation of an excessive biting force of the lid body 10 against the receiving frame 30. Moreover, the pressing force and the friction force which are generated between the outer peripheral portion 11 of the lid body 10 and the inner peripheral portion 31 of the receiving frame 30 make it possible to suppress rattling, vibration, noise, and sliding up of the lid body 10.

Particularly, in the case of the present embodiment, the lid fourth surface part 26 and the receiving-frame fourth surface part 44 are pressed against each other by the pressing force caused by the elastic deformation of the outer peripheral portion 11 of the lid body 10. Further, as a result of the lid fourth surface part 26 and the receiving-frame fourth surface part 44 which have been expanded in diameter being pressed against each other, the outer peripheral portion 11 of the lid body 10 is retained in a state of being prevented from coming out from the inner peripheral portion 31 of the receiving frame 30. As a result of this, it is possible and preferable to more effectively restrict the up-and-down movement of the lid body 10 by the pressing force, the friction force, and inhibition of coming out, compared with the cases of Embodiments 1 and 2.

Note that in the present embodiment, as in the case of Embodiments 1 and 2, by setting an inherent elastic modulus of the outer peripheral portion 11 of the lid body 10 and a section modulus of the outer peripheral portion 11 of the lid body 10, and an inherent elastic modulus of the inner peripheral portion 31 of the receiving frame 30 and a section modulus of the inner peripheral portion 31 of the receiving frame 30, the outer peripheral portion 11 of the lid body 10 is subjected to large elastic deformation. However, without being limited to that, it is also possible to set them such that the inner peripheral portion 31 of the receiving frame 30 is subjected to large elastic deformation, or that both the outer peripheral portion 11 of the lid body 10 and the inner peripheral portion 31 of the receiving frame 30 are subjected to appropriate elastic deformation.

Embodiment 4

Figure 13:
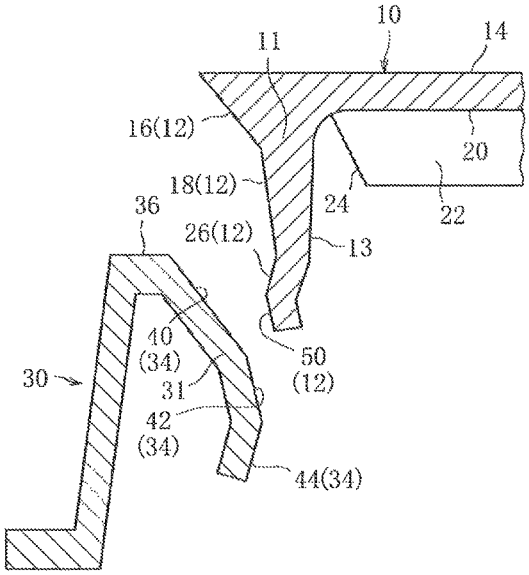
FIG. 13 is a longitudinal sectional view of a principal part of a lid for an underground structure relating to Embodiment 4 of the present invention.

FIG. 13 is a longitudinal sectional view of a principal part of a lid for an underground structure relating to Embodiment 4 of the present invention. Note that components overlapping with those of Embodiments 1 to 3 will be given the same reference symbols, thereby omitting the description thereof.

An inner peripheral surface 34 formed in an inner peripheral portion 31 of a receiving frame 30 of the present embodiment is, as in the case of Embodiment 3, made up of a receiving-frame first surface part 40 continuing to an upper surface 36 of the receiving frame 30, a receiving-frame second surface part 42 below the receiving-frame first surface part 40, and further a receiving-frame fourth surface part 44 below the receiving-frame second surface part 42.

On the other hand, an outer peripheral surface 12 formed in an outer peripheral portion 11 of a lid body 10 is made up of a lid first surface part 16 continuing to an upper surface 14 of the lid body 10, a lid second surface part 18 below the lid first surface part 16, further a lid fourth surface part 26 below the lid second surface part 18, and furthermore a lid fifth surface part 50 below the lid fourth surface part 26.

The lid fifth surface part 50 is formed below the lid fourth surface part 26 to have a gradient by reducing a diameter toward a downward direction of the lid body 10. Note that in the present embodiment, the lid fifth surface part 50 is formed to have a gradient of the same angle as that of the receiving-frame second surface part 42.

Figure 14:
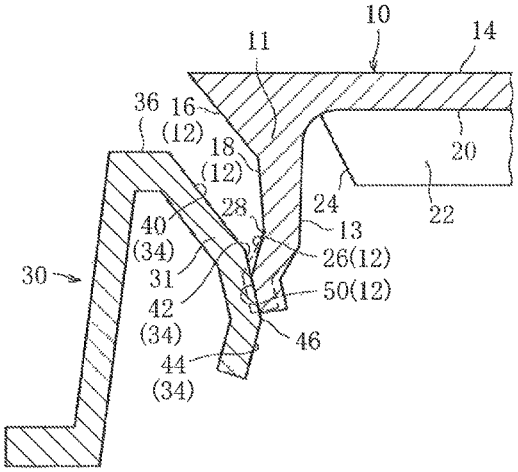
FIG. 14 is a longitudinal sectional view of a principal part of the lid for an underground structure relating to Embodiment 4 of the present invention, showing a state in which a lid fifth surface part is in abutment against a receiving-frame second surface part while the lid is being closed.

As shown in FIG. 14, when the lid body 10 is put into the receiving frame 30, the lid fifth surface part 50 and the receiving-frame second surface part 42 start abutting against each other, and when the lid body 10 is further put into the receiving frame 30, at least either one of the outer peripheral portion 11 of the lid body 10 and the inner peripheral portion 31 of the receiving frame 30 deforms elastically. Note that in the present embodiment, as shown in FIG. 14, the outer peripheral portion 11 of the lid body 10 is elastically deformed significantly in such a way to be reduced in diameter from a natural state shown by a dotted line to a state shown by a solid line.

Figure 15:
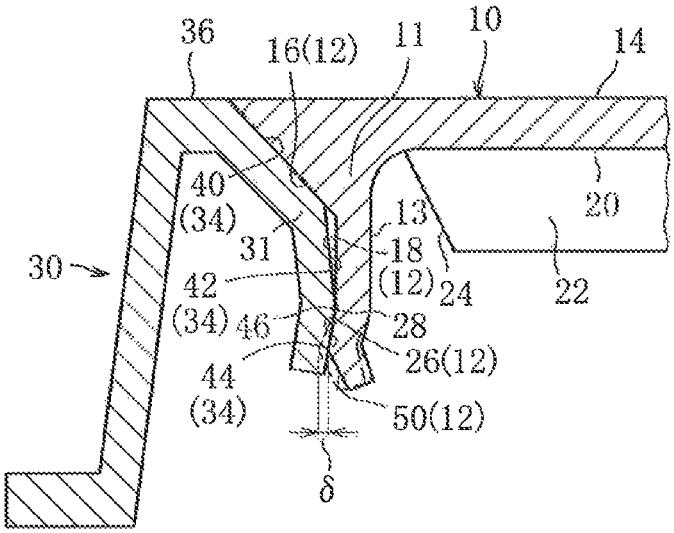
FIG. 15 is a longitudinal sectional view of a principal part of the lid for an underground structure relating to Embodiment 4 of the present invention in a closed-lid state in which a lid body is supported by a receiving frame.

In a closed-lid state shown in FIG. 15, the lid fourth surface part 26 and a lid fifth surface part 50 have crossed a border 46 between the receiving-frame second surface part 42 and the receiving-frame fourth surface part 44 from the state of FIG. 14 so that a border 28 between the lid second surface part 18 and the lid fourth surface part 26 has approximately coincided with the border 46, and the lid body 10 has fit into the regular closed-lid position of the receiving frame 30.

In this state, as in the case of Embodiment 3, as a result of the lid first surface part 16 being supported by the receiving-frame first surface part 40, the self-weight of the lid body 10 and load applied by a vehicle etc., travelling on the lid body 10 are supported by the receiving-frame first surface part 40. Further, the lid fourth surface part 26 and the receiving-frame fourth surface part 44 come into abutment against each other in the entire circumference, and the lid fourth surface part 26 and the receiving-frame fourth surface part 44 are pressed against each other by a pressing force caused by the elastic deformation of the outer peripheral portion 11 of the lid body 10. Further, as a result of the lid fourth surface part 26 and the receiving-frame fourth surface part 44 which have been expanded in diameter being pressed against each other, the outer peripheral portion 11 of the lid body 10 is retained in a state of being prevented from coming out from the inner peripheral portion 31 of the receiving frame 30.

The pressing force in this case is, as in the case of Embodiment 2, a restoring force which is generated as a result of the outer peripheral portion 11 of the lid body 10 being elastically deforming by a deflection amount δ from a natural state of FIG. 13, and acts against the receiving-frame fourth surface part 44 from the lid fourth surface part 26 in a diameter-expanding direction of the lid body 10.

As so far described, in the case of the present embodiment, since forming the lid fifth surface part 50 so as to have a gradient of an equal angle to that of the receiving-frame second surface part 42 makes it possible to cause the receiving-frame second surface part 42 to function as a guide plane of the lid fifth surface part 50 when putting the lid body 10 into the receiving frame 30, compared with the case of Embodiment 3 as shown in FIG. 11, it becomes possible to smoothly close the lid body 10, thereby significantly mitigating operator's burden of lid-closing work.

Embodiment 5

Figure 16:
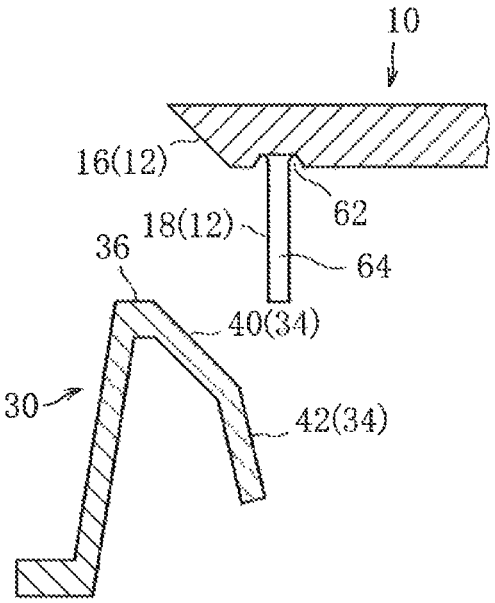
FIG. 16 is a longitudinal sectional view of a principal part of a lid for an underground structure relating to Embodiment 5 of the present invention.

FIG. 16 is a longitudinal sectional view of a principal part of a lid for an underground structure relating to Embodiment 5 of the present invention. Note that components overlapping with those of Embodiments 1 to 4 will be given the same reference symbols, thereby omitting the description thereof.

An inner peripheral surface 34 formed in an inner peripheral portion 31 of a receiving frame 30 of the present embodiment is, as in the case of Embodiment 1, made up of a receiving-frame first surface part 40 continuing to an upper surface 36 of the receiving frame 30, and a receiving-frame second surface part 42 below the receiving-frame first surface part 40.

On the other hand, an outer peripheral surface 12 formed in an outer peripheral portion 11 of a lid body 10 is made up of a lid first surface part 16 continuing to an upper surface 14 of the lid body 10, and a lid second surface part 18 below the lid first surface part 16.

Figure 17:
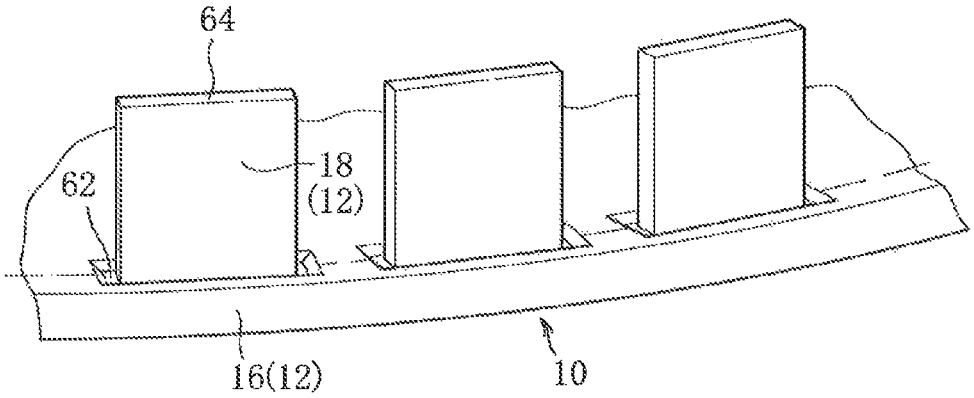
FIG. 17 is a perspective view seen from the back side of a lid body of the lid for an underground structure relating to Embodiment 5 of the present invention.

The lid second surface part 18 is formed of a plurality of protruding parts 64 which are spaced apart in the circumferential direction and configured to project below the lid first surface part. Further, at a base end of the protruding part 64, a concave part 62 is provided so as to surround the protruding part 64 as shown in FIGS. 16 and 17.

Figure 18:
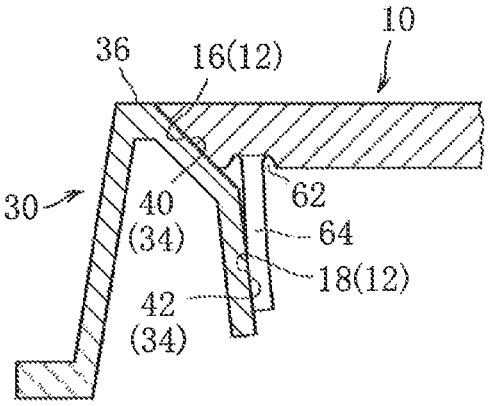
FIG. 18 is a longitudinal sectional view of a principal part of the lid for an underground structure relating to Embodiment 5 of the present invention in a closed-lid state in which the lid body is supported by a receiving frame.

In the closed-lid state shown in FIG. 18, as in the case of Embodiment 1, as a result of the lid first surface part 16 being supported by the receiving-frame first surface part 40, the self-weight of the lid body 10 and load applied by a vehicle etc., travelling on the lid body 10 are supported by the receiving-frame first surface part 40. Further, a lower part of the lid second surface part 18 and a lower part of the receiving-frame second surface part 42 come into abutment against each other, and the lid second surface part 18 presses the receiving-frame second surface part 42 due to a pressing force caused by the elastic deformation of the outer peripheral portion 11 of the lid body 10.

As so far described, in the case of the present embodiment, the concave part 62 is provided at the base end of the protruding part 64 so as to surround the protruding part 64. This makes it possible to keep the height of the protruding part 64 to be large while maintaining the height of the lid body to be a predetermined height (the height from the upper surface 14 of the lid body 10 to a lower end of the protruding part 64), which allows to facilitate elastic deformation of the protruding part 64, and is preferable.

Note that although in the present embodiment, the lid second surface part 18 is formed of the protruding part 64, this is not limiting, and the receiving-frame second surface part 42 can be formed of the protruding part.

The present invention is not limited to each of the above-described embodiments, and various modifications can be made thereto.

For example, the shapes of the lid body 10 and the receiving frame 30 are not limited to those of each embodiment as described above, it is of course possible to conceive other various modifications, such as a rectangular lid for an underground structure, provided they can generate a pressing force and a friction force resulting from the above-described elastic deformation of each part.

EXPLANATION OF REFERENCE SIGNS

10 Lid body
16 Lid first surface part
18 Lid second surface part
20 Back side
22 Reinforcing rib
24 End part
26 Lid fourth surface part
30 Receiving frame
40 Receiving-frame first surface part
42 Receiving-frame second surface part
44 Receiving-frame fourth surface part
48 Slit (cutout portion)
50 Lid fifth surface part
66 Receiving-frame third surface part
68 Lid third surface part

The invention claimed is:

1. A lid for an underground structure, comprising a lid body, and a receiving frame for supporting the lid body at an inner peripheral portion thereof in an openable/closable manner, wherein the inner peripheral portion of the receiving frame comprises:

a receiving-frame first surface part which is formed to have a gentle gradient forming an angle ranging from 25° to 45° with reference to a vertical line by reducing its diameter toward a downward direction of the receiving frame, a receiving-frame second surface part which is formed below the receiving-frame first surface part and with a steeper gradient than that of the receiving-frame first surface part by reducing its diameter toward the downward direction of the receiving frame, and a receiving-frame third surface part which is formed below the receiving-frame second surface part and with a gradient different from that of the receiving-frame second surface part by reducing its diameter toward the downward direction of the receiving frame, and an outer peripheral portion of the lid body comprises:

a lid first surface part which is formed to have a gentle gradient forming an angle ranging from 25° to 45° with reference to the vertical line by reducing its diameter toward a downward direction of the lid body, a lid second surface part which is formed below the lid first surface part and either vertically toward the downward direction of the lid body, or with a steeper gradient than that of the receiving-frame second surface part by reducing its diameter toward the downward direction of the lid body, and a lid third surface part which is formed below the lid second surface part and with a gradient different from that of the lid second surface part by reducing its diameter toward the downward direction of the lid body, and wherein in a closed-lid state of the lid body, the lid first surface part is supported by the receiving-frame first surface part, and at least one of the lid second surface part and the lid third surface part, and at least one of the receiving-frame second surface part and the receiving-frame third surface part are pressed against each other by a pressing force caused by elastic deformation of at least one of the outer peripheral portion of the lid body and the inner peripheral portion of the receiving frame.

2. The lid for an underground structure according to claim 1, wherein when the lid body is first put into the receiving frame, and thus into the closed-lid state, as a result of an outer peripheral surface or a lower surface of the outer peripheral portion of the lid body coming into abutment with an inner peripheral surface of the inner peripheral portion of the receiving frame, the outer peripheral portion of the lid body and/or the inner peripheral portion of the receiving frame undergoing plastic deformation while the pressing force caused by the elastic deformation remains.

3. The lid for an underground structure according to claim 1, wherein a plurality of cutout portions and/or a plurality of through holes are provided in a circumferential direction in the outer peripheral portion of the lid body and/or the inner peripheral portion of the receiving frame.

4. The lid for an underground structure according to claim 3, wherein the plurality of cutout portions and/or the plurality of through holes are provided in the outer peripheral portion of the lid body which is located below the lid second surface part and/or the inner peripheral portion of the receiving frame which is located below the receiving-frame second surface part.

5. The lid for an underground structure according to claim 1, wherein the outer peripheral portion of the lid body which is located below the lid second surface part and/or the inner peripheral portion of the receiving frame which is located below the receiving-frame second surface part is formed of a plurality of protruding parts which are spaced apart in a circumferential direction and configured to protrude therefrom.

6. The lid for an underground structure according to claim 5, wherein at a base end of the protruding part, a concave part is provided so as to surround the protruding part.

7. The lid for an underground structure according to claim 1, wherein a reinforcing rib is provided on a back side of the lid body, and an end part of the reinforcing rib is separated from an inner peripheral wall of the outer peripheral portion of the lid body.

* * * * *